US005480224A

United States Patent [19]

Ugalde

[11] Patent Number: 5,480,224

[45] **Date of Patent: * Jan. 2, 1996**

[54] CONVERTIBLE COMPUTER WORKSTATION

[75] Inventor: Carlos V. Ugalde, San Dimas, Calif.

[73] Assignee: Continental Engineering Group, Inc., Irwindale, Calif.

[ * ] Notice: The portion of the term of this patent subsequent to Nov. 15, 2011, has been disclaimed.

[21] Appl. No.: 320,448

[22] Filed: Oct. 11, 1994

Related U.S. Application Data

[63] Continuation of Ser. No. 704,462, May 23, 1991, Pat. No. 5,364,177.

[51] Int. Cl.[6] ..... A47B 21/03

[52] U.S. Cl. ..... 312/194; 312/223.3; 312/311

[58] Field of Search ..... 312/194, 196, 312/223.3, 208.1, 208.2, 7.2, 311; 248/139, 188.5

[56] References Cited

U.S. PATENT DOCUMENTS

| | | | |
|---|---|---|---|
| 4,562,482 | 12/1985 | Brown | 312/208.1 |
| 4,669,789 | 6/1987 | Pemberton | 312/194 |
| 4,766,422 | 8/1988 | Wolters et al. | 312/194 |
| 4,828,342 | 5/1989 | Stefan | 312/208.1 |
| 5,071,204 | 12/1991 | Price et al. | 312/194 |
| 5,094,514 | 3/1992 | Grosch | 312/194 |
| 5,364,177 | 11/1994 | Ugalde | 312/194 |

FOREIGN PATENT DOCUMENTS

| | | | |
|---|---|---|---|
| 2215197 | 9/1989 | United Kingdom | 108/136 |

*Primary Examiner*—Kenneth J. Dorner
*Assistant Examiner*—Gerald A. Anderson
*Attorney, Agent, or Firm*—Christie, Parker & Hale

[57] ABSTRACT

A convertible computer workstation comprising a desk having a horizontal working surface, a front panel, a vertical side panel located at one end of the working surface to support the working surface, a second vertical side panel located at the opposite end of the working surface to support the working surface, a third vertical support panel located approximately mid-way between the first and second side panel, a plurality of computer component shelves located between one side panel and the third support panel, a retractable keyboard drawer with a rear surface located between the opposite side panel and the third support panel, a monitor housing for supporting a computer monitor located behind the keyboard drawer comprising a horizontal working surface located within the desk working surface and hingedly connected to the desk front panel, a first side panel, a second side panel, a bottom panel, and a rear panel, all attached to the underside surface of the monitor housing working surface, means to lock the monitor housing in a first position, and means to automatically change the monitor housing from a first position to a second position.

14 Claims, 4 Drawing Sheets

CONVERTIBLE COMPUTER WORKSTATION

CROSS-REFERENCE TO RELATED APPLICATIONS

This application is a continuation of U.S. application Ser. No. 07/704,462, filed May 23, 1991, now U.S. Pat. No. 5,364,177, which is related to U.S. design application Ser. No. 07/634,499, filed Dec. 27, 1990, now U.S. Pat. No. D335,225 both assigned to a common assignee.

FIELD OF THE INVENTION

This invention relates to a computer workstation, and more particularly, to a computer workstation which allows conversion from a desk surface into a computer center instantly simply by sliding out the keyboard so that the monitor compartment opens automatically to its working position, providing maximum viewing and computer operator comfort.

BACKGROUND OF THE INVENTION

Today's computer workstation market is a highly competitive market offering a multitude of designs. However, most workstations that offer work surfaces do not give the operator the convenience or the amount of space needed to spread work or even provide a comfortable writing surface.

Computer workstations have been designed in an attempt to solve the problems of inadequate and uncomfortable working spaces. Once such design is illustrated in U.S. Pat. No. 4,669,789, in which the computer monitor compartment is supported underneath the work surface, and is brought to a viewing position by lifting the entire work surface. The problem with this design is that the workstation must be utilized as a computer workstation without the use of a working surface, or as a conventional desk without the use of the computer.

A second computer workstation design which offers both the capability of a computer workstation and an additional working surface is illustrated in U.S. Pat. No. 4,562,482. In this design, the monitor is supported by a bracket which is attached to an internal supporting structure in the computer workstation. The problem with this design is that the monitor must be manually rotated from its forward to its rear position and an additional piece must be inserted to cover the keyboard to take advantage of the entire working surface.

Thus, there exists a long-felt need in the art for a new and improved workstation which provides a computer workstation with a work surface which can be automatically converted entirely to a desk surface.

SUMMARY OF THE INVENTION

The present invention provides an improved convertible computer workstation which eliminates the problems of existing computer workstations, and is simple and inexpensive to manufacture.

The computer workstation of the present invention generally comprises a desk and a monitor housing. The desk comprises a top working surface, a front panel, two side support panels, and a third support panel located approximately mid-way between the two side support panels. Depending upon whether the computer workstation is made for a right-handed or left-handed individual, located between the third support panel and one of the side support panels are a number of shelves to support the central processing unit, the printer, and the printer paper. Additionally, there is a drawer for pens, pencils, notepaper and the like. Located between the third support panel and the other side support panel is a keyboard drawer and the monitor housing.

The keyboard drawer is actually supported by the third support panel and one of the side support panels, whereas the monitor housing, in addition to being supported by the third Support panel and one of the side support panels, is also supported by the front panel. The monitor housing consists of a top working surface, which lies flush with and fits into a corresponding cut-out section of the working surface of the desk, two side panels, a bottom panel, and a back panel. There is no front panel in the monitor housing, so when the monitor housing is raised to viewing level, the monitor can be seen.

The monitor housing remains in a first or closed position when the computer is not in use. In this position the top working surface of the monitor is flush with the desk working surface therefore creating an entire working surface. The monitor is locked into this position by a mechanism such as a peg protruding from the back of the keyboard drawer which mates with a bore located in the front end surface of a monitor housing side panel.

When the computer is to be used the monitor housing can automatically be raised to a second or viewing position. This position is accomplished by pulling the keyboard drawer forward releasing the peg from the bore which engages a lifting mechanism. The lifting mechanism is a spring biased mechanism such as a gas strut much like those used in the automotive industry to lift hatchbacks or trunk lids. The lifting mechanism slowly and continuously raises the monitor housing to its viewing position while cushioning the monitor from any sudden jerks or bumps.

DETAILED DESCRIPTION

Figure 1:
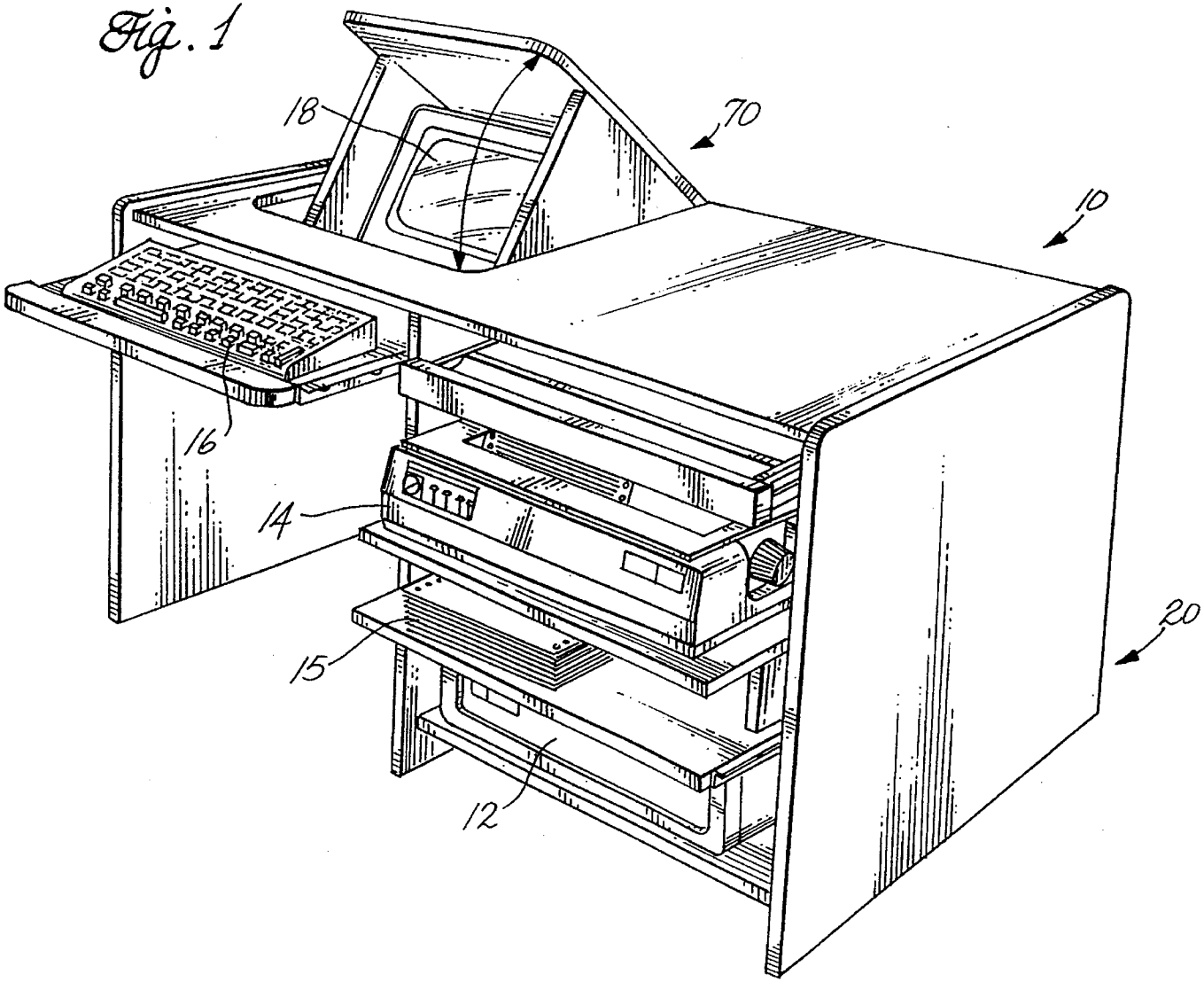
FIG. 1 is a perspective view of a computer workstation arrangement according to the principles of this invention, with the computer components shown in phantom for illustration purposes only and is not considered to be a part of the invention.

Referring to the drawings, FIG. 1 illustrates a convertible computer workstation 10 constructed in accordance with the principles of this invention. The workstation 10 comprises a desk 20 and a monitor housing 70. The monitor housing supports the monitor 18. The desk supports the monitor housing, as well as the rest of the computer components which are the central processing unit 12, printer 14, printer paper 15, and the keyboard 16.

Figure 2:
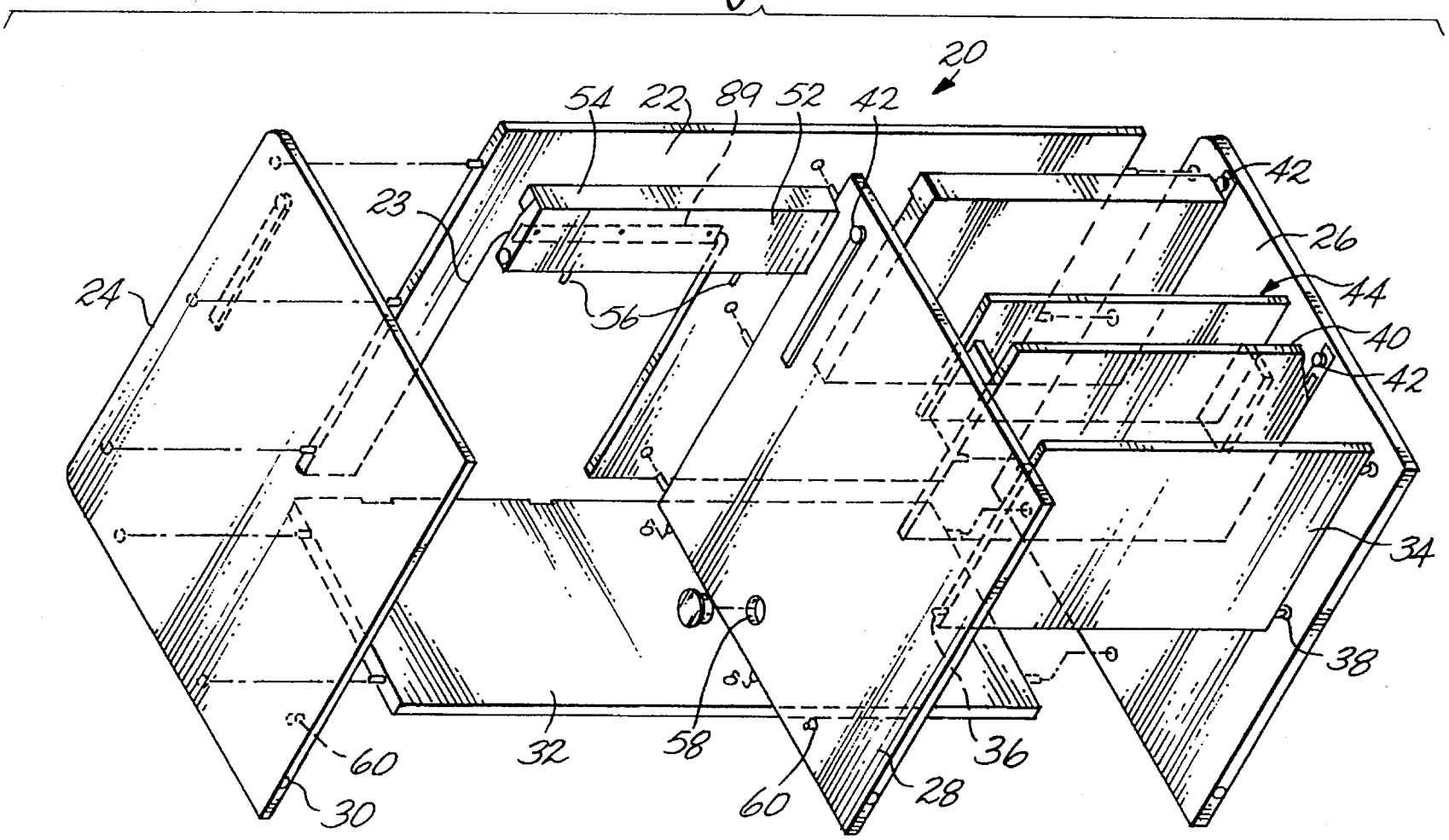
FIG. 2 is a perspective, exploded view of the desk component of the invention.

As can be seen in FIG. 2, the desk comprises a horizontal working surface 22 containing a cut-out portion 23 for the monitor housing. The working surface is supported by a left side panel 24, a right side panel 26, and a third intermediate panel 28 located approximately mid-way between the left and the right side panels. Located on the bottom edge of each of these three panels are rubber feet 30 used to engage and cushion the computer workstation on the floor. Perpendicular to each of the three panels, as well as the working surface, is a front panel 32 which forms the front of the desk.

Located between the intermediate panel and the right side panel are the computer component shelves. Located towards the bottom is the central processing unit (CPU) shelf 34 which supports the CPU. The shelf is secured to the side and intermediate panels by pins 36 in each end which mate with corresponding holes 38 in the intermediate and side panels. The shelf can also be secured to the side and intermediate panels with conventional hardware, such as wood screws. These two alternative means of securing the components together are representative methods for securing together all the components of the desk and the monitor housing, except where stated otherwise.

The next shelf above the CPU shelf is the printer paper shelf 40. Here is an instance where the paper shelf is not connected to the side and intermediate panels by the two previously discussed methods. Instead, the paper shelf is connected to the intermediate and side panels by the use of tracks 42. A track is located at either side of the paper shelf wherein one half of the track is secured to each edge of the paper shelf, and the other half of the track is secured to the inside surface of the right side panel and the inside surface of the intermediate panel. By using a track, the printer paper shelf can be pulled in and out in order to restock the shelf with printer paper and retrieve printed paper.

Resting upon the paper shelf, and attached thereto by one of the two previously discussed methods, is the printer shelf 44. The printer shelf comprises a top panel 45, a right side panel 46, and a left side panel 47. The right and left panels are attached to the paper shelf. Cut into the surface of the top panel of the printer shelf is a paper slot 48 which allows the paper to be fed from the paper shelf, through the printer shelf and into the printer. The printer shelf is only half as deep as the paper shelf which allows the printed paper exiting the printer to collect on the back side of the paper shelf.

The final component between the right side panel and the intermediate panel is a utensils drawer 50. The utensils drawer is used to store pens, pencils, note pads and the like. The utensils drawer is attached to the right side panel and the intermediate panel by the use of tracks, just like those used with the paper shelf.

Located between the left side panel and the intermediate panel at the top is the keyboard drawer 52. The keyboard drawer is attached to the panels likewise by a track. On the front of the keyboard drawer is a built-in wrist rest 54. This feature is included so that the operator's wrists can rest upon the drawer to avoid fatigue. Protruding from the rear of the keyboard drawer are two pegs 56, the significance of which will be discussed below.

A hole is located in the intermediate panel so that the electrical wiring from the keyboard and the monitor may be connected to the CPU. Located on the inside surface of the left side panel and the intermediate panel are engaging mechanisms 60 which help support the monitor housing.

Figure 3:
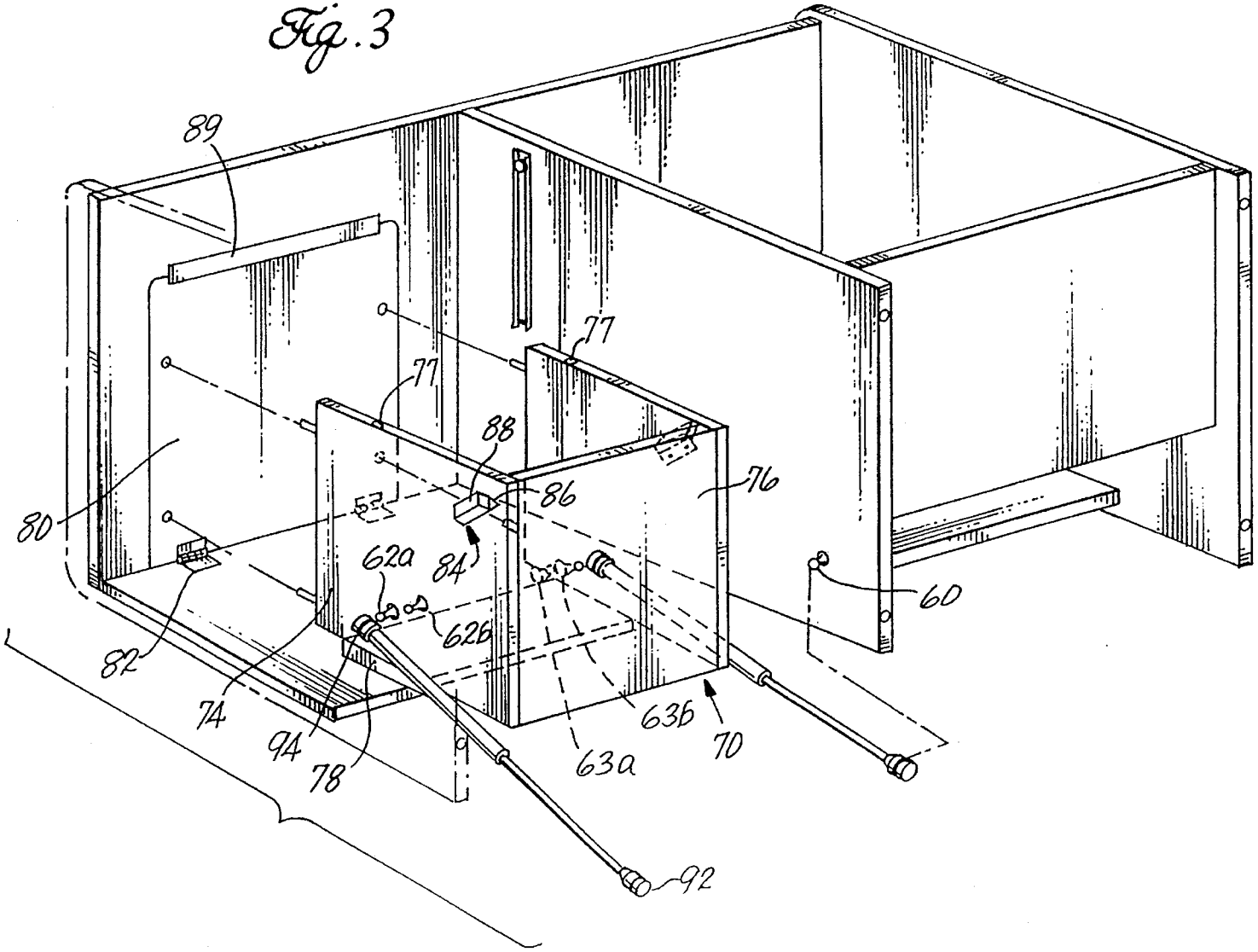
FIG. 3 is a perspective view illustrating the relationship between the desk component and the monitor housing component of the present invention.

FIG. 3 illustrates the monitor housing 70 which comprises a bottom panel 72, a left side panel 74, a right side panel 76, a rear panel 78, and a top panel 80. The bottom panel, left and right side panels, and rear panel are all fastened by either of the two methods previously discussed. The top panel of the monitor housing is connected to the rear panel of the desk with conventional hinges 82. The top panel, when closed, can also be utilized as a writing surface. The top panel is maintained flush with the desk working surface by bumper 89 attached to the underneath surface of the desk working surface at cut-out 23. The bumper resists any downward force exerted on the top panel when used as a writing surface. Once the top panel is connected to the front panel of the desk, the remaining assembled monitor housing components are attached to the bottom surface of the top panel.

Located on the outside surface of the left side panel and the right side panel of the monitor housing are left engaging mechanisms **62*a* and 62*b* and right engaging mechanisms 63*a* and 63*b*. Also located on the side panels of the monitor housing are foam bumpers 84. The foam bumpers comprise a metal angle bracket 86 and a foam cushion 88**. The bumpers are attached so that when the monitor housing is raised to its viewing position, the bumpers rest upon the bottom surface of the desk working surface and help to cushion any vibration exerted on the desk.

The monitor housing is raised to the viewing position by two spring-loaded pneumatic guides 90. Depending upon the weight of the monitor, the heavy ends 92 of the pneumatic guides are attached to the appropriate engaging mechanisms located on the sides of the monitor housing. The other or lighter ends 94 of the pneumatic guides are attached to the engaging mechanisms 60 located on the inside surfaces of the left side panel (not shown) of the desk and the intermediate panel of the desk.

In operation, the monitor housing is maintained in its closed position when the computer is not in use, wherein the top panel is flush with the working surface of the desk. The monitor housing is locked in the closed position by the two pegs protruding from the backside of the keyboard drawer mating with bores 77 in the front edges of the left side panel and right side panel of the monitor housing, thereby biasing the print-loaded pneumatic guides. In the closed position, the computer workstation has an unobstructed working surface which includes the working surface of the desk and the top surface of the monitor housing top panel.

Figure 4:
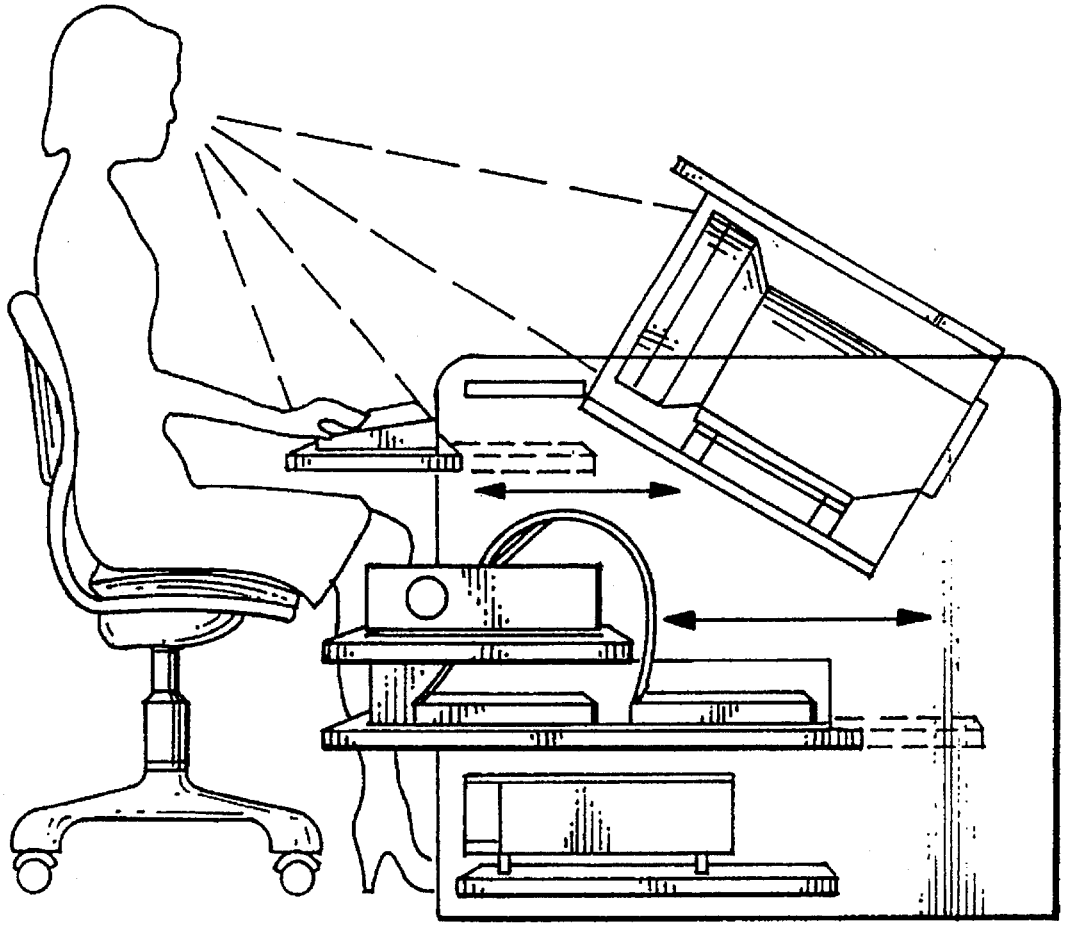
FIG. 4 is a cross sectional right side view of the computer workstation in the open position.

As can be seen in FIG. 4, when the user desires to operate the computer, the monitor housing is automatically raised to its viewing position by simply pulling out the keyboard drawer which releases the pegs from the bores, thereby disengaging the bias against the spring-loaded pneumatic guides. The guides exert an upward force which slowly raises the monitor housing to the open position until the foam bumpers engage the bottom surface of the desk working surface.

The spring-loaded pneumatic guides support the monitor housing in the open position until the user is finished operating the computer. To return the monitor housing to the closed position, the user simply pushes down on the top panel of the housing, overcoming the resistance of the pneumatic guides, until the top panel is again flush with the working surface of the desk and resting on bumper 89. The user then pushes the keyboard drawer back to its closed position, thereby engaging the pegs into the bores and locking the monitor housing in place.

Although the present invention has been described and illustrated with respect to a preferred embodiment thereof, it is to be understood that it is not to be so limited since changes and modifications may be made therein which are within the full intended scope of this invention as hereinafter claimed.

What is claimed is:

1. A computer workstation with an openable and closable flat surface, the workstation comprising:

a frame assembly having a first panel for defining a flat working surface and a plurality of vertical second support panels for supporting the first panel, the first panel having a cutout formed therein;

a monitor housing having a top panel, means for supporting a monitor, and means for defining an opening through which a monitor can be viewed;

means for mounting the monitor housing inside the frame assembly for movement between a closed position where the top panel of the monitor housing is disposed in the cutout of the first panel and parallel to the flat working surface to provide a complete working surface, and an open position wherein the top panel is above the flat working surface, and the opening is viewable from above the flat working surface;

a keyboard shelf for holding a keyboard;

means for attaching the keyboard shelf to the frame assembly such that the keyboard shelf is movable between a retracted position where it is disposed underneath the first panel and an extended position where it extends out from underneath the flat working surface; and means attached to the frame assembly for biasing the monitor housing from the closed position to the open position, wherein the keyboard shelf has first engagement means thereon, and the monitor housing has second engagement means thereon for cooperating with each other to hold the monitor housing in the closed position when the keyboard shelf is in the retracted position such that moving the keyboard shelf from the retracted position to the extended position disengages the cooperating first engagement means from the second engagement means, allowing the means for biasing to move the monitor housing to the open position.

2. The workstation of claim 1 wherein when the monitor shelf is in the closed position, the keyboard shelf is movable from the extended to the retracted position such that the first engagement means engages the second engagement means and holds the monitor housing in the closed position.

3. The workstation of claim 2 wherein the frame assembly further comprises a plurality of shelves to support computer components.

4. The workstation of claim 1 wherein the means for supporting a monitor comprises a bottom panel, and the means for defining an opening comprises side panels.

5. The workstation of claim 1 wherein a bumper mechanism is attached to the monitor housing for cushioning the monitor housing when the monitor housing is moved to the open position.

6. The workstation of claim 1 further comprising a plurality of computer component shelves.

7. The workstation of claim 1 wherein the plurality of computer component shelves include at least one of a stationary shelf for supporting a central processing unit, and a shelf for holding a printer, and a retractable shelf for storing printer paper.

8. The workstation of claim 1 wherein the means for attaching the monitor housing to the frame comprises a hinge.

9. The workstation of claim 1 wherein the means for biasing comprises spring-loaded pneumatic guides.

10. The workstation of claim 9 wherein the spring-biased, continuous-release mechanism is attached to the monitor housing and frame by means for adjusting a length of the mechanism to correspond with varying weights of a computer monitor.

11. A computer workstation comprising:

a desk, said desk comprising:

a first horizontal working surface, a desk front panel, a desk rear panel, a first vertical desk side panel located at one end of the working surface to support the working surface, a second vertical desk side panel located at the opposite end of the first working surface to support the first working surface, a vertical desk support panel located intermediate the first and second desk side panels, a plurality of computer component shelves located between the second vertical desk side panel and the desk support panel, and a retractable keyboard located between the first vertical desk side panel and the desk support panel;

a retractable keyboard drawer with a rear panel located between the opposite side panel and the third support panel, the keyboard drawer being movable between a retracted position within the desk to an extended position from the desk;

a monitor housing for supporting a computer monitor hingedly mounted to the desk and located behind the keyboard drawer and below the first horizontal working surface in a closed position, said monitor housing including a second horizontal working surface located within the first horizontal working surface;

means for attaching the monitor housing to an underside surface of the second horizontal working surface so that the monitor housing is movable between the closed position and an open position in which a monitor is viewable from above the first horizontal working surface;

first engagement means on the monitor housing and second engagement means on the keyboard drawer for engaging each other for holding the monitor housing in the closed position when the keyboard drawer is in the retracted position, and for disengaging when the keyboard drawer is moved from the retracted to the extended position; and mechanical means for biasing the monitor housing into the open position, whereby the monitor housing automatically moves to the open position in response to movement of the keyboard drawer from the retracted position to the extended position.

12. The workstation of claim 11 wherein the first engagement means comprises apertures formed in the monitor housing and projections from a rear of the keyboard drawer.

13. The workstation of claim 11 wherein the monitor housing further comprises first and second monitor housing side panels, each with a front surface, a bottom monitor housing panel, and a rear monitor housing panel.

14. The workstation of claim 11 wherein the means for attaching the monitor housing comprises a hinge.

* * * * *